US005779003A

United States Patent [19]

Carty

[11] Patent Number: 5,779,003

[45] Date of Patent: Jul. 14, 1998

[54] COLLAPSIBLE SAWHORSE

[76] Inventor: Walter F. Carty, 654 School St., Lowell, Mass. 01851

[21] Appl. No.: 782,417

[22] Filed: Jan. 14, 1997

[51] Int. Cl.[6] ..... F04G 1/32

[52] U.S. Cl. ..... 182/225; 182/155; 182/181.1

[58] Field of Search ..... 182/153, 154, 182/155, 181.1, 186.3, 225, 226, 227

[56] References Cited

U.S. PATENT DOCUMENTS

| | | | |
|---|---|---|---|
| 1,881,755 | 10/1932 | Logan et al. . | |
| 2,275,353 | 3/1942 | Engert | 304/5 |
| 2,312,956 | 1/1943 | Campbell | 304/5 |
| 2,594,464 | 4/1952 | Loucks, Jr. | 182/225 |
| 2,666,673 | 1/1954 | Hughes | 182/225 |
| 3,978,943 | 9/1976 | Greenman et al. | 182/155 |
| 4,238,001 | 12/1980 | Alexander | 182/153 |
| 4,298,094 | 11/1981 | Strong | 182/155 |
| 4,325,463 | 4/1982 | Taylor | 182/225 X |
| 4,730,698 | 3/1988 | Harris | 182/153 |
| 5,020,634 | 6/1991 | Gunderson et al. | 182/225 X |
| 5,215,162 | 6/1993 | Parks et al. | 182/153 |
| 5,404,962 | 4/1995 | Carter | 182/225 X |

*Primary Examiner*—Daniel P. Stodola
*Assistant Examiner*—Richard M. Smith
*Attorney, Agent, or Firm*—Pearson & Pearson

[57] ABSTRACT

A work support or sawhorse having a pair of identical but reversed in arrangement brackets at each end of a horizontal rail for supporting legs and each end of the horizontal rail. Each bracket comprises rotatable leg sections for holding the legs and hinges to enable each pair of legs to collapse against the underside of the horizontal rail. The leg sections are outwardly angled providing increased sawhorse stability. Tabs at the top of the leg sections insert into tab slots on the bottom of a hinged top plate for providing a stable sawhorse.

14 Claims, 4 Drawing Sheets

COLLAPSIBLE SAWHORSE

BACKGROUND OF THE INVENTION

1. Field of the Invention

This invention relates to a work support or sawhorse used by carpenters, masons and other artisans and in particular to an improved bracket which when used as a pair and fitted with legs and a horizontal rail extending between the pair, forms a collapsible horse.

2. Description of Related Art

In U.S. Pat. No. 1,881,755 issued Oct. 11, 1932 to M. C. Logan et al. a collapsible horse is described which is made with legs so hinged and associated that the legs may be collapsed against the underside of the body of the horse whereby the horse may be readily carried from place to place and conveniently stored. However, there is no locking means associated with the hinges to prevent them from accidently collapsing.

In U.S. Pat. No. 2,275,353 issued Mar. 3, 1942 to G. J. Engert a folding leg structure is described adapted for use with folding tables, chairs, carpenters' folding trestles or horses, and benches. In particular a sawhorse is shown having hinged plates attached at each end of the sawhorse to the legs and a horizontal support body, a jackknife line is connected between each pair of legs to limit the separation of the pair of legs. However, braces extending from each leg to the bottom of the horizontal support body are required for providing stability to the sawhorse.

In U.S. Pat. No. 2,312,956 issued Mar. 2, 1943 to H. C. Campbell, a collapsible horse is described having a combination of compound hinges being similar in construction but reversed in arrangement at the opposite ends of an upper horizontal rail. Two legs and the rail are attached to each compound hinge which allows the legs at each end to swing toward and away from each other and to swing the pairs of legs in laterally inward directions into substantially parallelism beneath the horizontal rail. However, the compound hinges do not provide a stable sawhorse as required when the distance between the legs is reduced resulting in the legs of one side being folded within the legs of the other side when in the collapsed position.

SUMMARY OF THE INVENTION

It is therefore an object of this invention to provide a bracket capable of being used on either end of a collapsible sawhorse.

It is another object of this invention to provide an improved collapsible sawhorse employing a pair of identical brackets.

It is another object of this invention to provide an improved collapsible sawhorse having end brackets that enable the legs of the sawhorse to collapse under the horizontal rail attached between the end brackets.

It is a further object of this invention to provide a collapsible sawhorse with improved stability.

These and other objects are accomplished by providing a bracket comprising a top plate having upward extending side walls on three sides, the top plate being hinged on portions of a fourth side to portions of a first side section and having an opening for accommodating a solid bar interconnecting the first side section to a second side section, leg sections, positioned to swing between the ends of the side sections toward and away from each other, for insertion of legs for support of the bracket, downward extensions on the ends of two of the side walls of the top plate for resting against the leg sections when the leg sections are spread apart and prohibiting the top plate from rotating about the hinged connection, and tab means extending inwardly from the top of each of the leg sections for insertion into tab slots beneath the side walls of the top plate. The leg sections comprise a slot opposite each of the side wall downward extensions when the leg sections swing toward each other thereby providing openings for the downward extensions to pass through allowing the top plate to move about the hinged fourth side. The bracket comprises a locking bar having a first end attached to a first of the leg sections and a second end attached to a second of the leg sections whereby the locking bar presents an unintended movement of the leg sections toward each other when locked in a horizontal position. The top plate having the three side walls provides for positioning a linear work surface on the top plate extending over the hinged side.

The objects are further accomplished by providing a collapsible sawhorse comprising bracket means for forming a first end and a second end of the sawhorse, each of the bracket means comprises a top plate, a pair of interconnected opposing side sections and leg sections, each of the leg sections being positioned between the pair of side sections, the leg sections being attached between the side sections so as to swing toward and away from each other, leg means inserted into the leg sections of the first end and the second end for supporting the sawhorse, means secured to the top plate of the bracket means at the first end and the second end for providing a work area on the sawhorse, hinge means connecting an edge of the top plate to an edge of one of the side sections of the bracket means for enabling the leg means to swing laterally under the work area means, and tab means extending inwardly from the top of each of the leg sections for insertion into tab slots provided beneath the sides of the top plate. Each of the bracket means comprises a locking bar having a first end attached to a first of the leg sections and a second end attached to a second of the leg sections whereby the locking bar prevents an unintended movement of the leg sections toward each other when locked in a horizontal position. The work area means secured between the first end and the second end of the sawhorse comprises a linear rail or board. The top plate comprises side walls having downward extensions on the ends of two of the side walls for resting against a side of the leg sections of the bracket means when the leg sections are spread apart thereby preventing lateral motion of the leg means. The leg sections comprise a slot opposite each of the downward extensions of the side walls for passage of the downward extensions when the leg sections are moved toward each other exposing each slot and allowing the leg sections to move laterally under the work area means.

The objects are further accomplished by providing a method of forming a collapsible sawhorse comprising the steps of positioning bracket means at a first end and a second end of the sawhorse, providing for each of the bracket means a top plate, a pair of interconnected opposing side sections and leg sections, each of the leg sections being positioned between the pair of the opposing side sections, the leg sections being attached between the side sections so as to swing toward and away from each other, inserting leg means into the leg sections of the first end and the second end for supporting the sawhorse, providing a work area on the sawhorse by securing means to the top plate of the bracket means at the first end and the second end, connecting an edge of the top plate to an edge of one of the side sections of the bracket means with hinge means for enabling the leg means to swing laterally under the work area means, and inserting tab means extending inwardly from the top of each of the leg sections into tab slots provided beneath the sides of the top plate. The method comprises the step of providing each of the bracket means with a locking bar having a first end attached to a first of the leg sections and a second end attached to a second of the leg sections whereby the locking bar prevents an unintended movement of the leg sections toward and away from each other when locked in a horizontal position. The step of providing a work area comprises the step of securing a linear rail between the first end and the second end of the sawhorse. The method comprises the step of providing the top plate with side walls having downward extensions on the ends of two of the side walls for resting against a side of the leg sections of the bracket means when the leg sections are spread apart thereby preventing lateral motion of the leg means about the hinge means. The method further comprises the step of providing a slot in the leg sections opposite the downward extensions of the side walls of the top plate for passage of the downward extensions when the leg sections are moved toward each other, allowing the leg section to move laterally under the work area.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
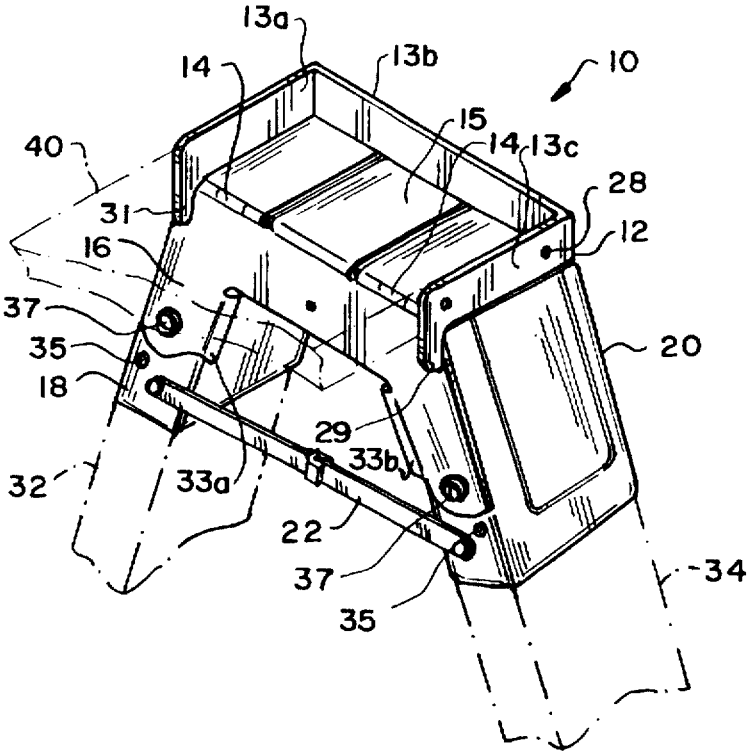
FIG. 1 is a perspective view of a bracket for constructing a sawhorse having at one end two legs shown in an open position and having a top portion for supporting a horizontal rail which is shown in dash-dot lines.
Figure 2:
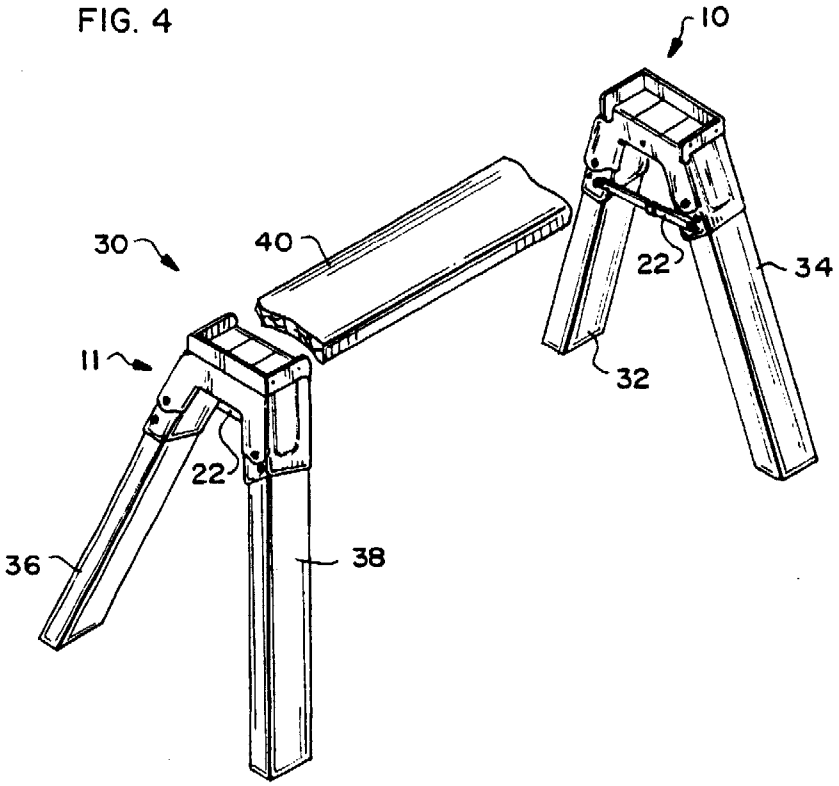
FIG. 2 is a perspective view of the bracket of FIG. 1 being used at two ends to construct a sawhorse.

Referring to FIG. 1 and FIG. 2, a bracket 10 is shown in FIG. 1 which when used in pairs such as brackets 10, 11 as shown in FIG. 2, provides an improved collapsible work support or sawhorse 30. The bracket 10 comprises two leg sections 18, 20 which are used for supporting the bracket 10 and are held in position between two side sections 16, 17 interconnected by a solid bar 15. A locking bar 22 secures the leg sections 18, 20 in an open position. A hinged top plate 12 receives an end of a horizontal rail 40 (shown in phantom) providing the top work area of the sawhorse 30 of FIG. 2. The horizontal rail 40 is supported by brackets 10, 11 at each end. The leg sections 18, 20 receive 2"×4" legs 32, 34 (shown in phantom) made of wood or other suitable material which function as vertical supports for the bracket 10 and for the sawhorse 30. The legs 32, 34 are secured by inserting nails or screws 35 through holes in the sides of the leg sections 18, 20.

Figure 3:
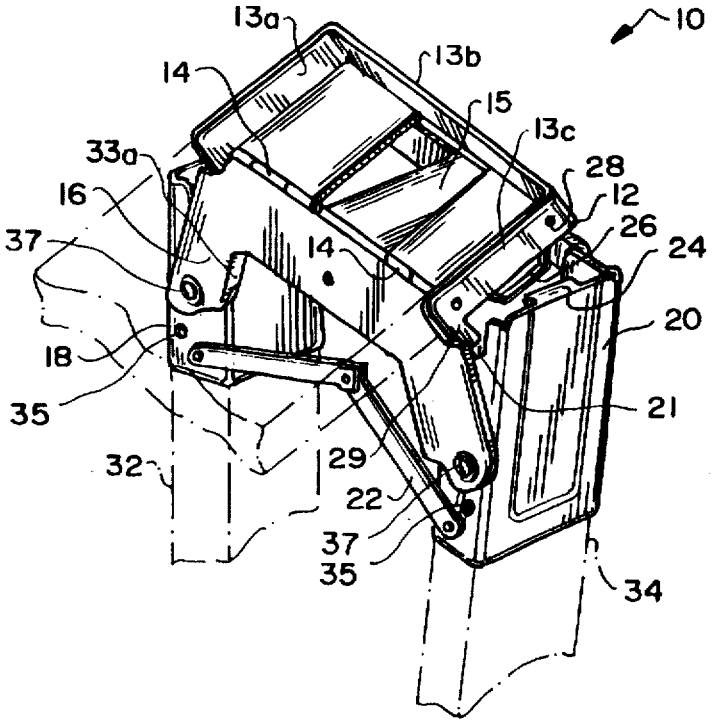
FIG. 3 is a perspective view of a bracket showing the legs in a partially collapsed position allowing the top plate of the bracket to rotate about a hinge.

Still referring to FIG. 1 and also FIG. 3, the leg sections 18, 20 swing toward and away from each other between side sections 16, 17 of bracket 10. The hinged top plate 12 comprises three upward extending side walls 13*a*, 13*b*, 13*c*. *Side walls 13a* and 13*c* each have tab slots 26, 27 on their bottom edges. The top plate 12 is hinged at two locations to the top edge of side section 16 of the bracket 10. In between the hinges 14 is the solid bar 15 interconnecting side sections 16, 17. An opening is provided in the top plate 12 for accommodating the solid bar 15 which provides for a stable bracket 10 when in the collapsed position. The hinge 14 allows the leg sections 18, 20 to be folded under the horizontal rail 40 for storage purposes. However, downward extension 29, 31 at the ends of sides 13*a* and 13*c* of top plate 12 prevent the leg sections 18, 20 from moving about the hinge 14, unless the leg sections 18, 20 are first folded toward each other after raising the locking bar 22 from its horizontal position as shown in FIG. 3. As the leg sections 18, 20 move toward each other, slots 21 (FIG. 3) in the side of the leg sections 18, 20 allow the downward extensions 29, 31 to enter, and the leg sections 18, 20 are now able to rotate about hinge 14 under the horizontal rail 40.

Referring now to FIG. 3, a perspective view of the bracket 10 showing the legs 18, 20 in a partially collapsed position allowing the top plate 12 to rotate about the hinges 14. With the legs 18, 20 in the collapsed state the tabs 24, 25 are released from the slots 26, 27 which permits the top plate to rotate about hinges 14 in addition to the downward extensions 29, 31 passing through slots 21 in each of the leg sections 18, 20. The side sections 16, 17 of bracket 10 are attached to the sides of the leg sections 18, 20 by means of machine screws 37 with washers and nuts commonly used for such connections to allow the leg sections 18, 20 to rotate approximately 30 degrees toward and away from each other. The brackets 10, 11 comprising the top plate 12, side sections 16, 17 and leg sections 18, 20 are made from aluminum, steel or other suitable material readily available and known to one of ordinary skill in the art.

Figure 4:
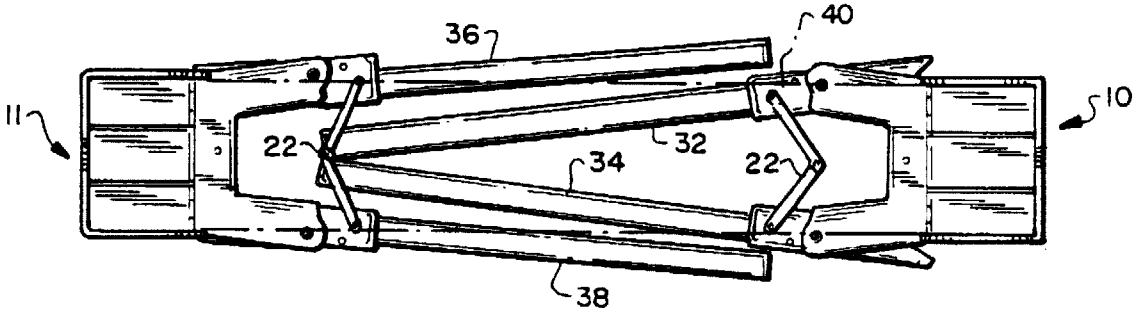
FIG. 4 is a top view of a collapsed horse in accordance with the invention showing the legs on each end folded together and rotated 90 degrees under a top cross-rail whereby the legs on the right side are folded within the legs on the left side.

Referring now to FIG. 4, a top view of a collapsed sawhorse 30 is shown with the legs 32, 34, 36, 38 on each side collapsed toward each other and rotated 90 degrees under a top crossboard or rail 40 (shown in phantom) whereby the legs on the right side are positioned within the collapsed legs on the left side. In such a collapsed state the sawhorse 30 is easy to carry and store in a vehicle or otherwise.

Figure 5:
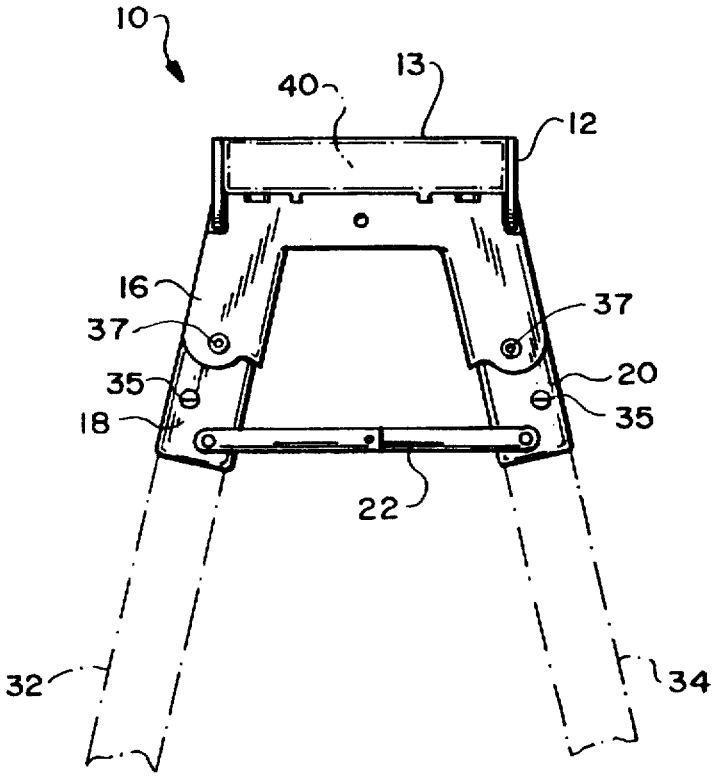
FIG. 5 is an end view of a bracket in a fully opened position showing a locking bar in a horizontal position attached between two leg sections of the bracket.

Referring now to FIG. 5, an end view of the bracket 10 is shown in a fully opened position with the legs 32, 34 and top rail 40 shown in phantom. The locking bar 22 is attached at one end to leg section 18 of bracket 10 and at the other end to leg section 20. In this position the locking bar 22 is fully horizontal relative to the top rail 40 thereby being in the locked position. The locking bar 22 provides for a stable horse 30 when the sawhorse 30 is being used by an artisan.

Figure 6:
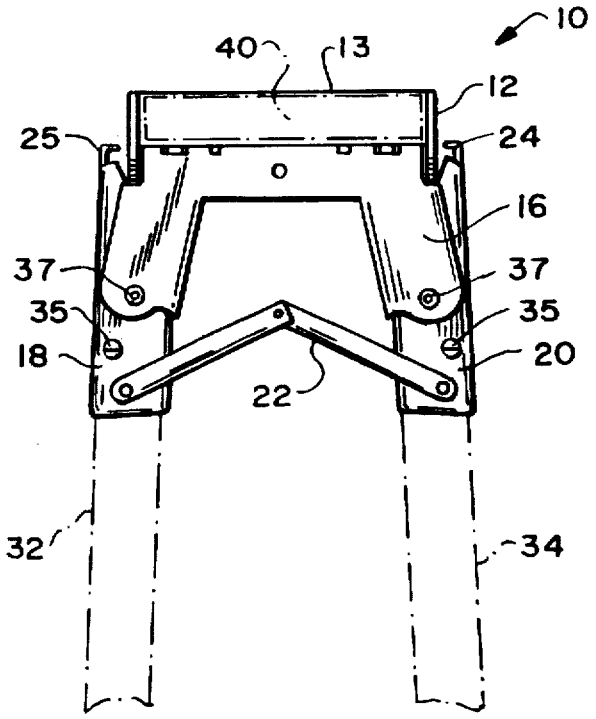
FIG. 6 is an end view of a bracket in a partially collapsed position showing the tabs at the top of the bracket leg section removed from slots under the top plate and a locking bar folding at an angle to the horizontal as the two legs shown in dash-dot lines are moving toward each other.

Referring now to FIG. 6, an end view of the bracket 10 is shown in a partially collapsed state showing the tabs 24, 25 that extend inward from the side of the top of the leg sections 18, 20 and showing locking bar 22 folding at an angle to the horizontal as the legs 32, 34 are rotating toward each other.

Figure 7:
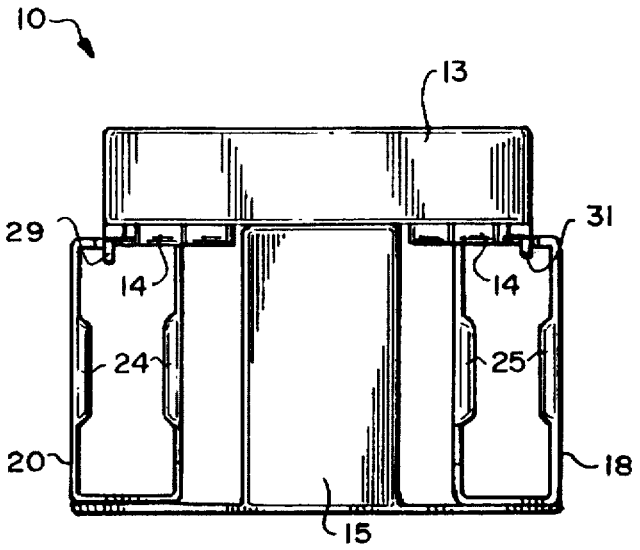
FIG. 7 is a top view of a bracket showing a hinged top plate for holding a horizontal rail rotated by ninety degrees to the horizontal exposing the top of the leg sections showing the tabs that lock into the bottom of the hinged top plate.

Referring now to FIG. 7, a top view of the bracket 10 shows the hinged top plate 12 for holding the horizontal board or rail 40 rotated by ninety degrees exposing the top of the leg sections 18, 20 showing the tabs 24, and 25. Each leg section 18, 20 has two tabs facing each other; this provides for universal leg sections 18, 20 which may be used on either side of a bracket 10. Also, visible in FIG. 7 are the downward extensions 29, 31 of the top plate 12 extending into slots 21 in the sides of leg sections 16, 20 thereby allowing the top plate 12 to rotate about hinges 14.

Figure 8:
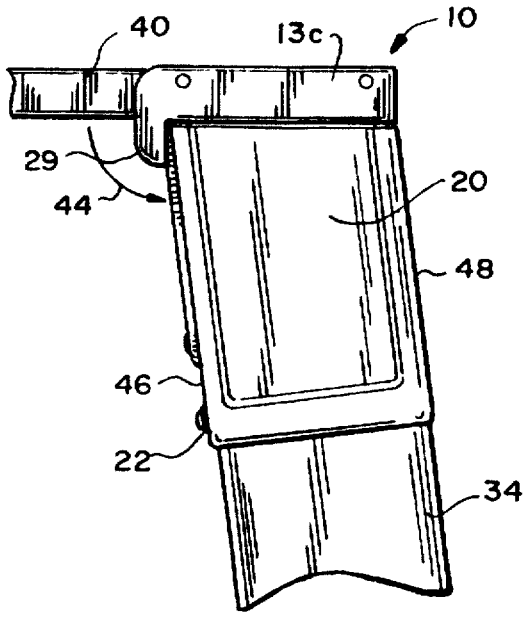
FIG. 8 is a side view of an end bracket of a collapsible sawhorse showing the stable angle of the legs with respect to the top horizontal board.

Referring now to FIG. 8, a side view of the bracket 10 of the collapsible sawhorse 30 is shown. The angle 44, which is greater than ninety degrees, that the leg section 20 makes with the horizontal rail 40 provides for improved stability of the sawhorse 30. The angle 44 is obtained by the design of the leg sections. The height of the left side 46 of the leg section 20 is longer than the height of the right side 48 resulting in a slanting top edge causing the leg sections 18, 20 to extend outward to the right side resulting in angle 44 being greater than 90 degrees and the sawhorse 30 having the improved stability.

Figure 9:
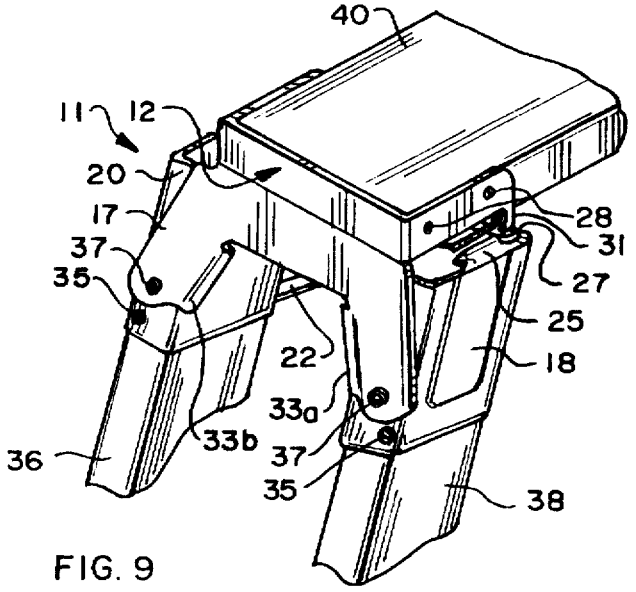
FIG. 9 is a perspective view of a collapsible bracket showing the legs in a partially collapsed position and showing a locking tab at the top of the right leg section and the tab slot under the top plate which the tab enters when the legs are extended.

Referring now to FIG. 9, a perspective view of the collapsible bracket 11 of sawhorse 30 is shown with the legs 36, 38 in a partially collapsed position. The locking tab 25 at the top of the right leg section 18 is shown removed from the slot 27. Also shown in FIG. 9 are flanges 33*a* and 33*b* which provide stops for the leg sections 18, 20 (in addition to tabs 24, 25) when the leg sections 18, 20 are fully spread open. Holes 28 in the side of the top plate 12 provide for securing the rail 40 to the top plate 12 by means of nails, screws, or bolts.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A bracket comprising:

a top plate having upward extending side walls on three sides, said top plate being hinged on portions of a fourth side to portions of a first side section and having an opening for accommodating a solid bar interconnecting said first side section to a second side section;

leg sections, positioned to swing between the ends of said side sections toward and away from each other, for insertion of legs for support of said bracket;

downward extensions on the ends of two of said side walls of said top plate for resting against said leg sections when said leg sections are spread apart and prohibiting said top plate from rotating about said hinged connection; and tab means extending inwardly from the top of each of said leg sections for insertion into tab slots beneath said side walls of said top plate.

2. The bracket as recited in claim 1 wherein said leg sections comprise a slot opposite each of said side wall downward extensions when said leg sections swing toward each other thereby providing openings for said downward extensions to pass through allowing said top plate to move about said hinged fourth side.

3. The bracket as recited in claim 1 wherein said bracket comprises a locking bar having a first end attached to a first of said leg sections and a second end attached to a second of said leg sections whereby said locking bar presents an unintended movement of said leg sections toward each other when locked in a horizontal position.

4. The bracket as recited in claim 1 wherein said top plate having said three side walls provides for positioning a linear work surface on said top plate extending over said hinged side.

5. A collapsible sawhorse comprising:

bracket means for forming a first end and a second end of said sawhorse;

each of said bracket means comprise a top plate, a pair of interconnected opposing side sections and leg sections, each of said leg sections being positioned between said pair of side sections, said leg sections being attached between said side sections so as to swing toward and away from each other;

leg means inserted into said leg sections of said first end and said second end for supporting said sawhorse;

means secured to said top plate of said bracket means at said first end and said second end for providing a work area on said sawhorse;

hinge means connecting an edge of said top plate to an edge of one said side sections of said bracket means for enabling said leg means to swing laterally under said work area means;

said top plate comprises side walls having downward extensions on the ends of two of said side walls for resting against a side of said leg sections of said bracket means when said leg sections are spaced apart thereby prohibiting said top plate from rotating about said hinged means;

said leg sections comprise a slot opposite each of said downward extensions of said side walls for passage of said downward extensions when said leg sections are moved toward each other exposing each slot and allowing said leg sections to move laterally under said work area means; and tab means extending inwardly from the top of each of said leg sections for insertion for insertion into slots provided beneath the sides of said top plate.

6. The collapsible sawhorse as recited in claim 5 wherein each of said bracket means comprises a locking bar having a first end attached to a first of said leg sections and a second end attached to a second of said leg sections whereby said locking bar prevents an unintended movement of said leg sections toward each other when locked in a horizontal position.

7. The collapsible sawhorse as recited in claim 5 wherein said work area means secured between said first end and said second end of said sawhorse comprises a linear rail.

8. The collapsible sawhorse as recited in claim 5 wherein said leg sections comprise a downwardly slanting top edge abutting said top plate thereby providing an inside angle greater than ninety degrees between said work area providing means and said leg means for improved stability.

9. A method of providing a bracket comprising the steps of:

providing a top plate having upward extending side walls on three sides and portions of a fourth side of said top plate being hinged to portions of a first side section and having a solid bar interconnecting said first side section to said second side section;

inserting legs for support of said bracket into leg sections, said leg sections positioned to swing between said side sections toward and away from each other;

prohibiting said top plate from rotating about said hinged connection with downward extensions on the ends of two of said side walls of said top plate for resting against a side of said leg sections when said leg sections are spread apart; and inserting tab means, extending inwardly from the top of each of said leg sections, into tab slots beneath said side walls of said top plate.

10. The method as recited in claim 9 wherein said step of prohibiting said top plate from rotating comprises the step of providing said leg sections with a slot opposite each of said side wall downward extensions when said leg sections swing toward each other, thereby providing openings for said downward extensions to pass through allowing said top plate to move about said hinged fourth side.

11. The method as recited in claim 9 wherein said method comprises the step of providing a locking bar having a first end attached to a first of said leg sections and a second end attached to a second of said leg sections whereby said locking bar presents an unintended movement of said leg sections toward each other when locked in a horizontal position.

12. A method of forming a collapsible sawhorse comprising the steps of:

positioning bracket means at a first end and a second end of said sawhorse;

providing for each of said bracket means a top plate, a pair of interconnected opposing side sections and leg sections, each of said leg sections being positioned between said pair of said opposing side sections, said leg sections being attached between said side sections so as to swing toward and away from each other;

inserting leg means into said leg sections of said first end and said second end for supporting said sawhorse;

providing a work area on said sawhorse by securing means to said top plate of said bracket means at said first end and said second end;

connecting an edge of said top plate to an edge of one of said side sections of said bracket menas with hinge means for enabling said leg means to swing laterally under said work area means;

providing said top plate with side walls having downward extensions on the ends of two of said side walls for resting against a side of said leg sections of said bracket means when said leg sections are sperad apart thereby preventing lateral motion of said leg means about said hinge means;

providing a slot in said leg sections opposite said downward extensions of said side walls of said top plate for passage of said downward extensions when said leg sections are moved toward each other, allowing said leg sections to move laterally under said work area; and inserting tab means extending inwardly from the top of each of said leg sections into tab slots provided beneath the sides of said top plate.

13. The method as recited in claim 12 wherein said method comprises the step of providing each of said bracket means with a locking bar having a first and attached to a first of said leg sections and a second end attached to a second of said leg sections whereby said locking bar prevents an unintended movement of said leg sections toward and away from each other when locked in a horizontal position.

14. The method as recited in claim 12 wherein said step of providing a work area comprises the step of securing a linear rail between said first end and said second end of said sawhorse.

* * * * *